United States Patent [19]

Avrillon et al.

[11] 4,152,249

[45] May 1, 1979

[54] PROCESS FOR PURIFYING HYDROCARBONS BY ADSORPTION

[75] Inventors: Rene Avrillon, Maisons Laffitte; Daniel Defives, Paris, both of France

[73] Assignee: Institut Francais du Petrole, Rueil-Malmaison, France

[21] Appl. No.: 872,539

[22] Filed: Jan. 26, 1978

[30] Foreign Application Priority Data

Jan. 26, 1977 [FR] France ..... 77 02345

[51] Int. Cl.[2] ..... C10G 25/12

[52] U.S. Cl. ..... 208/212; 208/299; 210/24; 252/414

[58] Field of Search ..... 208/212, 299, 291, 290, 208/307, 188, 184, 240, 301, 255; 210/24

[56] References Cited

U.S. PATENT DOCUMENTS

| | | | |
|---|---|---|---|
| 3,119,766 | 1/1964 | Voltz et al. | 208/290 |
| 3,922,217 | 11/1975 | Cohen et al. | 208/299 |
| 4,045,330 | 8/1977 | Avrillon et al. | 208/184 |

FOREIGN PATENT DOCUMENTS

| | | | |
|---|---|---|---|
| 842485 | 12/1976 | Belgium. | |
| 2313442 | 12/1976 | France. | |
| 410074 | 4/1974 | U.S.S.R. | 208/188 |

*Primary Examiner*—George Crasanakis
*Attorney, Agent, or Firm*—Millen & White

[57] ABSTRACT

A hydrocarbon cut is purified by contact with a solid adsorption resin consisting of a porous polycondensate or cross-linked copolymer comprising pyridyl or hydroxy groups and having pores essentially in the range of 6 to 300 Angströms.

15 Claims, No Drawings

PROCESS FOR PURIFYING HYDROCARBONS BY ADSORPTION

This invention concerns the purification of hydrocarbon cuts, for example those useful as diluents, lamp oils, kerosines, Diesel fuels, heating oils, motor oils, medicinal oils, raw materials for the chemical and biochemical synthesis, etc, as obtained, for example, from the oil straight-run distillation or the catalytic hydrogenation of hydrocarbon cuts, for example by hydrocracking, hydrorefining or hydrofinishing.

The invention is particularly concerned with the treatment of hydrocarbon feedstocks containing undesirable components, either for technical or for sanitary reasons.

The process of the invention may be used to purify lamp oils, kerosines and gas oils, particularly to remove therefrom not only aromatic but also olefinic and heterocyclic unsaturated polycyclic compounds, which make the combustion fuliginous; the extract may be used to manufacture dyes. Another application of the process is the removal of toxic materials from white-spirits, medicinal oils, paraffinic fractions destined to the production of proteins by fermentation, industrial oils, lubricating oils, etc.

In particular the mutagenic and carcinogenic constituents, irrespective of their chemical nature, which remains relatively unknown, may be eliminated in totality. The process may also be applied to lubricating oils, either for increasing their viscosity index by extraction of unsaturated constituents, or as finishing treatment, to improve color, acidity, etc., by removal of oxygen-, nitrogen- and sulfur- containing impurities. As concerns hydrorefined oils, the process also permits to increase the stability to sun rays by eliminating the substances convertible to insoluble or strongly colored compounds under the influence of U.V. radiations.

A hydrorefined oil is a lubricating oil obtained by a process comprising treating with hydrogen an oily hydrocarbon cut (preferably at least 90% of its constituents have a normal boiling point above 360° C.) such as a vacuum distillate or a deasphalted vacuum residuum. This treatment with hydrogen may be the sole treatment applied to the cut or may be part of a chain of treatments comprising, for example, a solvent extraction; in that case, the hydrogen treatment may be a hydrofinishing treatment.

The above hydrogen treatment may be conducted at temperatures of 300° to 450° C., under pressures from 20 to 150 bars, at hourly rates of 0.1 to 10 volumes per volume of catalyst and with a hydrogen amount of, for example, 200 to 5,000 liters per liter of liquid hydrocarbon charge.

In the process according to the invention, the hydrocarbon charge to be purified is contacted with an absorption resin whose porosity is at least 0,1 cc per gram as pores of 6 to 300 Angstroms approximate diameter; the impurities retained by the resin may be desorbed thereafter with an organic solvent.

According to a prior patent U.S. Pat. No. 4,045,330 issued Aug. 30, 1977, this process was applied as finishing treatment to used lubricating oils previously subjected to a main purification treatment. The problem was quite different since used motor oils contain impurities of quite different nature: metal compounds, oxidation and cracking products due to the oxidizing atmosphere of the motors. The treatment of used lubricating oils is not encompassed by the invention.

The adsorption resins which may be used, in the pure state or as mixtures, in the process of the invention are preferably polycondensates or cross-linked copolymers comprising either hydroxy groups linked directly or through a $$-CH_2- \text{ or } \overset{|}{CH}-$$

group to a benzene ring, or pyridyl groups; their useful pore volume, i.e. the volume of the pores of diameter from about 6 to 300 Angstroms, is at least 0.1 cc per gram, for example, from 0.1 to 0.8 cc per gram. The pore volume may be determined, for example, by nitrogen adsorption according to the B.E.T. method or by isopentane or methyl isobutyl ketone adsorption; the latter two substances do not penetrate into pores of a diameter lower than about 6 Angstroms; mercury porosimetry may additionally be used although it applies only to pores of diameter larger than about 38 Angstroms.

Particularly effective adsorption resins are the porous polycondensates of phenol and/or resorcinol with formaldehyde and/or 2-furaldehyde, such as the phenol-formaldehyde resin commercialized by DiaProsim Company under the name Duolite S 30, and the porous polycondensates of aliphatic ketones with bis-arylaldehydic compounds optionally comprising one or more phenol and/or pyridyl groups between the two terminal aromatic aldehyde groups; an example of the latter type of adsorption resin is the resin manufactured by Societe Rhone-Poulenc under reference YD 74 and which is a polycondensate of acetone and 4,4'-bis (paraformylstyryl) -2,2'-bipyridyle.

Other resins are the porous cross-linked copolymers of (a) at least one vinylpyridine with (b) at least one poly-unsaturated monomer such as divinylbenzene, with possibly another monomer having ethylenic unsaturation.

The preparation of the absorption resins to be used in the present process is carried out under known conditions leading to the formation of polymers having a macroporous structure. However, for some resins, for example those of the ketone-bisarylaldehyde type, porosity is normally present only if the resin is impregnated with a liquid; if the latter is removed, for example by evaporation under vacuum, porosity disappears, but it may appear again, more or less easily, when using certain solvents, one of the most effective being methylene chloride. In that case the methods for measuring the pore volume by nitrogen adsorption or mercury penetration do not apply. One may have recourse, however, to the adsorption of methylisobutylketone.

The adsorption resins are active for the purification of oils only if they are practically anhydrous, i.e. if they contain less than 3%, preferably less than 1% b.w. of water (determined by the Karl Fischer method). It may happen that water is present, either in the fresh resin, depending on the manufacture process, or in the resin under use, by accident. Certain adsorption resins are stable only at moderate temperature, for example below 80° C.; it is then desirable to dehydrate them, not by heating, but by rinsing with a light alcohol or a light ketone, for example an alcohol of less than 5 carbon atoms or a ketone of less than 7 carbon atoms. It will be shown thereafter that such substances are useful for reactivating the resin after use. It is then advantageous to employ the same substance for the dehydration and the reactivation of the resin. The resins may also be dehydrated by keeping them under vacuum or in a dry atmosphere, but this method should be avoided when treating resins of the ketone-bisarylaldehyde type.

In the present process, the adsorption resins are used as particles of any shape; their particle size is preferably lower than 3 mm and usefully from 0.3 to 1.2 mm.

The hydrocarbon cut may be contacted with the adsorption resin in any manner, for example according to the technique of the fixed or fluidized bed, the fixed bed being however preferred. If the cut has a high viscosity, it is advantageous to dilute it before processing. The diluent may be any substance which is neither polar nor polarizable, is relatively volatile with respect to the oil in order to be separable therefrom by distillation, and appears at the processing temperature as a liquid of low viscosity, preferably lower than 0.5 centipoise. Highly advantageous diluents are saturated aliphatic and alicyclic hydrocarbons whose molecule contains 3 to 7 carbon atoms. The dilution rate, expressed as parts by volume of diluent per part of oil, is preferably from 1 to 4, although lower or higher rates may be used.

A rather strict condition, when using adsorption resins, is the operating temperature. In fact, as stated hereinbefore, the resins which are employed in the present process are stable only in a limited temperature range. It is thus necessary to operate in the stability domain of the resin, in most cases below 80° C., preferably below about 50° C. There is no lower temperature limit, except that imposed by considerations of viscosity of the liquid treated.

As to the pressure, it is practically without effect on the resin. The pressure is normally atmospheric, but a higher pressure may be used without disadvantage when, for example, it is necessary to maintain the diluent in the liquid state.

The contact time depends largely on the molecular weight of the treated hydrocarbons and their impurities. The larger the molecules of the impurities, the slower their diffusion in the pore lattice of the resin. The treatment of heavy oils may thus require fairly long contact times. As a rule a small particle size of the resin and a low viscosity of the liquid medium help to reduce the contact time necessary to good purification of the oil. Dilution of highly viscous oils is nearly a necessity. When operating in fixed bed, the contact time, defined as the residence time of the liquid in the bed, is usually more than 1 minute and generally in the range from a quarter of an hour to one hour for a particle size of 0.1 to 2 mm and a viscosity of 0.15 to 1.0 centipoise.

If desired, in view of improving the effect of the adsorption resin, the oil to be purified may be subjected to a preliminary treatment by means of a porous polymer of low polarity, preferably with large pores, able to retain very big or highly polar molecules of impurities and to release them easily when passing the solvent employed for reactivating the adsorption resin. Examples of porous polymers of low polarity are the porous acrylic polymers of the trade, preferably of the macroporous type, whose particle size is close to that of the adsorption resin to be used.

The amount of oil which can be purified with a given amount of adsorption resin depends on the concentration of the various impurities. Further, all impurities are not retained by a given resin with the same efficiency. The operating conditions and, in particular, the mode of contact also influence the purification capacity of the resin. An advantageous mode of contact in this respect is percolation in fixed bed. By way of example, the resins to be used in the present process permit, when in a fixed bed, to purify from 2 to 5 times their volume of hydrocarbon cut.

The reactivation of the resins after use, i.e. the adsorption of the impurities, is carried out by washing with an organic solvent. If it is desired to obtain the impurities separate from the feedstock to be purified (in order to valorize these by-products or increase the yield of purified material), desorption may be performed by rinsing with a diluent such as hereinbefore defined. The solvents to be used for the reactivation are, as a rule, organic substances of average polarity or polarizability which are liquid at the operating temperature and pressure, miscible to the treated hydrocarbons, and separable therefrom and preferably also from the optional diluent, by distillation. Hyghly advantageous substances for the reactivation of the resins are aliphatic and alicyclic alcohols having from 1 to 6 carbon atoms per molecule, aliphatic and alicyclic ketones having from 3 to 7 carbon atoms, chlorinated hydrocarbons, for example mono-, di-, tri and tetrachloromethane, 1,2-dichloroethane, trichloroethylene, light aromatic hydrocarbons such as benzene, toluene, xylenes and ethylbenzene, and except for resins having pyridyl groups, pyridine and its methyl derivatives. In practice, the reactivation solvents may be said substances either pure or as mixtures.

The larger the amount of impurities to desorb, the bigger the volume of solvent to be used for the reactivation of the resins. However it may be reduced by choosing a convenient operating technique. The most advantageous technique, as regards the amount of solvent, is the fixed bed technique with circulation of the solvent in reverse direction to the treated hydrocarbons, the liquid of larger density being circulated upwardly. The circulation of solvent is effected at a preferred flow rate of 0.5 to 4 volumes per volume of bed and per hour. In these conditions, the required volume of solvent is usually 0.1 to 2 times, preferably 0.3 to 0.8 times that of the oil to be purified. Another advantage of the fixed bed technique is the following: once solvent washed, the bed can be used again; it is not necessary to remove the liquid or rinse with a diluent before percolating the hydrocarbons. In fact, the solvent hold-up is pushed by the hydrocarbons and does not mix much with the latter, provided the liquid of higher density is discharged or injected (depending on what is concerned: solvent or oil) at the bottom of the bed. Only when thorough purification is concerned, can the desorption be followed with rinsing by means of an inert diluent of the type previously disclosed.

The following purely illustrative examples will explain more fully the possibilities of the present invention.

EXAMPLES OF EXTRACTION OF POLYCYCLIC COMPOUNDS FROM A KEROSINE

- Example 1*a*:

Extraction with a new phenol-formaldehyde resin.

The kerosine to be treated has a density of 0.783. It contains 18.77% b.w. of unsaturated cyclic compounds, including 17.02% monocyclic, 1.68% bicyclic and 0.07% higher compounds. The monocyclic compounds are essentially benzene derivatives; the polycyclic compounds include a number of sulfur and nitrogen rings.

There is used a glass percolation column of 2 cm internal diameter and 120 cm height, with an outer thermostatic jacket through which water at about 20° C. is circulated. The column is charged with 377 cc of phenol-formaldehyde resin of grain size between 0.3 and 1.0 mm and whose useful pore volume is 0.65 cc per gram (as determined on a sample dried in vacuo).

Water (37 g) and optional impurities of the resin are removed by washing first with 1,000 cc of acetone supplied from the top of the column at a rate of 300 cc per hour (residual water in the resin: 0.6% b.w.), then with 500 cc of benzene supplied in the same manner. The kerosine to be purified is passed thereafter. The latter is injected from the top of the column at a rate of 300 cc/hour. The first 200 cc of effluent contain practically only benzene and are set apart. The next 1,500 cc (1,167 g) are analyzed: they are practically free from unsaturated polycyclic compounds (less than 0.01% b.w.) but contain 14.50% b.w. of monocyclic unsaturated compounds consisting almost exclusively of monoaromatic hydrocarbons.

- Example 1*b*:

Extraction by means of a reactivated phenol-formaldehyde resin.

The resin bed used in example 1*a* is reactivated by means of 1,000 cc of benzene injected at the bottom of the column at a rate of 300 cc per hour. An additional treatment of the kerosine is performed in the same conditions as in example 1*a*. An effluent is collected, which is practically free (<0.01% b.w.) of polycyclic compounds and comprises 14.6% b.w. of monocyclic compounds. Its weight is 1,169 g.

- Example 1*c*:

Extraction with a fresh bipyridylic resin.

A column of the same type as in example 1*a* is filled up with 377 cc of water-saturated Rhone-Poulenc YD 74 resin (90 g) having a grain size between 0.4 and 1.2 mm and a useful pore volume of 0.70 cc per gram of dehydrated resin. As in example 1*a*, water is removed from the resin bed by using 1,500 cc, instead of 1,000 cc of acetone, and washing with 500 cc of benzene.

Kerosine is then passed in the same conditions as in example 1*a*. 1,168 g of effluent is obtained; it is practically free (<0.01% b.w.) of polycyclic compounds and contains 14.40% b.w. of monocyclic compounds.

EXAMPLES OF DETOXICATION OF A N-PARAFFIN CUT

- Example 2*a*:

Detoxication by means of a fresh phenol-formaldehyde resin.

The n-paraffin cut to be purified has been extracted from a gas oil cut by means of a zeolite molecular sieve of the 5A type. It has a density of 0.771 at 20° C. It contains 6,000 parts per billion b.w. of aromatic hydrocarbons, including 12 parts per billion b.w. of benz[a]pyrene, and is mutagenic according to the Ames test on Salmonella Typhimurium bacteria (cf. Ames B.N. et al., Mutational Research 31, 347–364, [1975]).

This cut is subjected to the treatment of example 1*a*, except that acetone and benzene are replaced by ethyl alcohol. 1,000 cc of dearomatized paraffins are collected; their benz[a]pyrene content is lower than 1 part per billion b.w., and it is not mutagenic according to the Ames test.

- Example 2*b*:

Detoxication by means of a reactivated phenol-formaldehyde resin.

The resin column of example 2*a* is reactivated by means of 900 cc of ethyl alcohol supplied at the bottom of the column at a rate of 300 cc per hour. A treatment of the n-paraffinic cut is effected again in the conditions of example 2*a*. The results are unchanged.

EXAMPLES OF FINISHING OF AN OILY CUT

- Example 3*a*:

Finishing with a fresh phenol-formaldehyde resin.

The oily cut to be purified is a furfural-refined 350 Neutral Solvent base. Its properties are: specific gravity: 0.880, color index: 3 (AFNOR T 60–104), acid number: 0.06 (AFNOR T 60–112), Conradson residue: 0.12 (AFNOR T 60–116), viscosity index: 97 (AFNOR T 60–136); it is slightly turbid, which is due to some wetness.

The treatment of example 1*a* is applied to this oil, except that the temperature of the column is 60° C. instead of 20° C. and acetone and benzene are replaced by methylethylketone, which obliges to reverse the circulation of the product to be purified and the solvent since methylethylketone is lighter than oil. The oil feed rate is 125 cc per hour instead of 300 cc per hour. 1,000 cc of clear oil is obtained which has a color index of 2.5, an acid index of 0.03, a Conradson residue of 0.06 and a viscosity index of 99.

- Example 3*b*:

Finishing with a reactivated phenol-formaldehyde resin.

The bed of resin employed in example 3*a* is reactivated with 900 cc of methylethylketone introduced at the top of the column at a rate of 250 cc per hour. A new treatment of the oily cut is effected in the conditions of example 3*a* with the same results.

- Example 3*c*:

Finishing with a fresh bi-pyridylic resin.

The experiment of example 3*a* is repeated except that the phenol-formaldehyde resin is replaced with the Rhone-Poulenc YD 74 resin described in example 1*c*. The results are substantially unchanged.

EXAMPLES OF STABILIZATION OF A HYDROREFINED OIL

- Example 4*a*:

Stabilization with a fresh phenol-formaldehyde resin.

The oil to be stabilized is a turbine lubricating base produced by hydrorefining a vacuum oil distillate. Its specific gravity is 0.852 at 20° C. It is unstable in the presence of U.V. rays: a sample maintained at 70° C. in front of an U.V. lamp has formed a precipitate after about 20 hours.

This oil is treated as in example 3*a*, except that the column is prepared with acetone and then benzene but not with methylethylketone, as in example 1*a*. 1,000 cc of oil are obtained which give no precipitate after a 48 hours exposure to an U.V. lamp at 70° C.

- Example 4*b*:

Stabilization with a reactivated phenol-formaldehyde resin.

The column of resin of example 4*a* is reactivated with 900 cc of benzene introduced at the top of the column at a rate of 250 cc per hour. A new treatment of the oil is effected in the conditions of example 4*a*. The result is unchanged.

What we claim is:

1. A process for purifying a hydrocarbon cut recovered from crude oil by distillation or by catalytic hydrogenation of such a cut, with the exclusion from said process of the purification of used lubricating oils, wherein said cut is contacted with particles of a solid adsorption resin consisting of a porous polycondensate or cross-linked copolymer comprising (a) pyridyl groups (b) hydroxy groups linked directly or through a $$-CH_2- \text{ or } -\overset{|}{CH}-$$

group to a benzene ring or (c) a mixture of said pyridyl and said hydroxy groups, said resin having 0.1 to 0.8 cc/g of pores whose diameter is from about 6 to 300 Angstroms, and whose water content is lower than 1% by weight.

2. A process according to claim 1, wherein the resin is a polycondensate of phenol with formaldehyde.

3. A process according to claim 1, wherein the resin is a polycondensate of acetone with 4,4'-bis(paraformylstyryl) -2,2'-bipyridyl.

4. A process according to claim 1, wherein the resin is in the form of particles in a fixed bed.

5. A process according to claim 5, wherein the contact time is from 15 minutes to 1 hour.

6. A process according to claim 1, wherein the hydrocarbon cut before being contacted with a solid adsorption resin is treated with a macroporous polymer.

7. A process according to claim 1, wherein the contacting step is followed with the resin reactivation by contact with an organic solvent.

8. A process according to claim 7, wherein the organic solvent is an alcohol, a ketone, an aromatic hydrocarbon or a chlorinated hydrocarbon.

9. A process according to claim 1, wherein the hydrocarbon cut subjected to the treatment is a straight-run lubricating oil.

10. A process according to claim 1, wherein the hydrocarbon cut subjected to the treatment is a hydrorefining lubricating oil which is unstable to U.V. rays.

11. A process according to claim 1, wherein the hydrocarbon cut comprises both unsaturated monocyclic compounds and unsaturated polycyclic compounds, and there is collected a hydrocarbon cut selectively impoverished in unsaturated polycyclic compounds or freed thereof.

12. A process according to claim 1, wherein the hydrocarbon cut contains condensed polynuclear aromatic hydrocarbons and there is collected a hydrocarbon cut impoverished in the latter hydrocarbons or freed thereof.

13. A process according to claim 1, wherein the hydrocarbon cut comprises mutagenic compounds and there is collected a hydrocarbon cut impoverished in the latter compounds or freed thereof.

14. A process according to claim 1, wherein the hydrocarbon cut is lamp oil, kerosine or gas oil.

15. A process according to claim 1, wherein the cut is a lubricating oil solubilized in a diluent.

* * * * *